US008522894B2

(12) United States Patent
Kraenzler et al.

(10) Patent No.: US 8,522,894 B2
(45) Date of Patent: Sep. 3, 2013

(54) HAND MACHINE TOOL COMPRISING AT LEAST ONE HANDLE

(75) Inventors: Ernst Kraenzler, Leinfelden-Echterdingen (DE); Manfred Ruff, Stuttgart (DE); Harald Krondorfer, Ludwigsburg (DE); Ralph Dammertz, Stuttgart (DE); Joerg Goehner, Boeblingen-Dagersheim (DE); Mario Frank, Remshalden (DE); Franz Scheschark, Neuenstadt (DE)

(73) Assignee: Robert Bosch GmbH, Stuttgart (DE)

( * ) Notice: Subject to any disclaimer, the term of this patent is extended or adjusted under 35 U.S.C. 154(b) by 1930 days.

(21) Appl. No.: 10/049,546

(22) PCT Filed: May 25, 2001 (Under 37 CFR 1.47)

(86) PCT No.: PCT/DE01/02024

§ 371 (c)(1), (2), (4) Date: Jun. 5, 2003

(87) PCT Pub. No.: WO03/043785

PCT Pub. Date: May 30, 2003

(65) Prior Publication Data

US 2005/0224244 A1 Oct. 13, 2005

(30) Foreign Application Priority Data

Jun. 15, 2000 (DE) ..... 100 29 536

(51) Int. Cl.
*B25D 17/24* (2006.01)

(52) U.S. Cl.
USPC ..... 173/162.1; 173/162.2

(58) Field of Classification Search
USPC ..... 173/162.1, 162.2, 211, 136.1, 162, 173/136; 30/381, 382, 383, 384
See application file for complete search history.

(56) References Cited

U.S. PATENT DOCUMENTS

| | | | | |
|---|---|---|---|---|
| 1,683,334 | A | 9/1928 | Chilton | |
| 3,728,793 | A * | 4/1973 | Makinson et al. | 30/383 |
| 4,603,904 | A | 8/1986 | Tolleson et al. | |

(Continued)

FOREIGN PATENT DOCUMENTS

| | | |
|---|---|---|
| DE | 1 103 773 | 3/1961 |
| DE | 1 628 926 | 9/1971 |

(Continued)

OTHER PUBLICATIONS

"Kunststoff-Lexikon" Carl Hanser Verlag Muenchen 1973, p. 375 (With Certified English Translation).

*Primary Examiner* — Rinaldi Rada
*Assistant Examiner* — Nathaniel Chukwurah
(74) *Attorney, Agent, or Firm* — Michael J. Striker

(57) ABSTRACT

The invention is based on a power tool with at least one handle (10, 26, 50, 62, 104) that comprises at least one grip part (12, 72, 106) that is firmly connected to a mounting part (16, 70, 110) via at least one elastic, vibration-damping element (14, 24, 52, 108), via which the grip part (12, 72, 106) is affixable to a housing (60).
It is proposed that the connection between the grip part (12, 72, 106) and the mounting part (16, 70, 110) is secured by means of the elastic element (14, 24, 52, 108) via at least one movable retaining element (20, 22, 28, 64, 112).

20 Claims, 8 Drawing Sheets

(56) References Cited

U.S. PATENT DOCUMENTS

| | | | | | |
|---|---|---|---|---|---|
| 4,995,598 | A | | 2/1991 | Ingham | |
| 5,046,566 | A | * | 9/1991 | Dorner et al. | 173/162.2 |
| 5,052,500 | A | * | 10/1991 | Ohtsu | 173/162.2 |
| 5,157,807 | A | | 10/1992 | Keller et al. | |
| 5,453,577 | A | * | 9/1995 | Everett et al. | 173/211 |
| 5,697,456 | A | | 12/1997 | Radle | |
| 5,699,865 | A | * | 12/1997 | Forderer et al. | 173/162.2 |
| 6,412,180 | B1 | * | 7/2002 | Wolf et al. | 30/381 |
| 7,126,366 | B2 | | 10/2006 | Ohashi et al. | |
| 7,332,926 | B2 | | 2/2008 | Ohashi et al. | |
| 7,740,087 | B2 | | 6/2010 | Krondorfer et al. | |

FOREIGN PATENT DOCUMENTS

| | | | |
|---|---|---|---|
| DE | 28 04 223 | A | 8/1979 |
| DE | 81 19 172.3 | | 11/1981 |
| DE | 32 25 815 | | 12/1983 |
| DE | 87 01 722.9 | | 4/1987 |
| DE | 87 01 722.9 | | 5/1987 |
| DE | 40 11 124 | | 10/1991 |
| DE | 41 24 574 | | 1/1993 |
| DE | 195 30 712 | | 2/1997 |
| DE | 195 30 712 | A | 2/1997 |
| DE | 199 55 931 | A | 2/2001 |
| DE | 100 05 080 | | 8/2001 |
| EP | 0 213 089 | | 3/1987 |
| EP | 0 336 627 | | 10/1989 |
| EP | 0 995 553 | | 4/2000 |
| GB | 586 608 | | 3/1947 |
| JP | 53-127256 | | 11/1978 |
| JP | 56163839 | | 12/1981 |
| JP | 06124183 | | 5/1994 |
| JP | 4628096 | | 2/2011 |
| JP | 4628421 | | 2/2011 |

* cited by examiner

HAND MACHINE TOOL COMPRISING AT LEAST ONE HANDLE

RELATED ART

The invention is based on a power tool with at least one handle according to the preamble of claim 1.

A handle for guiding or holding vibrating devices was made known in DE 87 01 722.9 C1. The handle comprises a grip part having a metal core coated with a vibration-damping plastic. A first piece of sheet metal is connected to the metal core on one end via a screw, which first piece of sheet metal is connected to a second piece of sheet metal via an elastic buffer in the axial direction opposite to the grip part. The second piece of sheet metal, in turn, is connected to a guide shaft of the device via a screw.

ADVANTAGES OF THE INVENTION

The invention is based on a power tool with at least one handle that comprises at least one grip part that is firmly connected to a mounting part via at least one elastic, vibration-damping element, via which the grip part is affixable to a housing.

It is proposed that a connection between the grip part and the mounting part is secured using the elastic element via at least one movable retaining element. If the elastic element becomes damaged, the grip part can be prevented from separating from the housing, and control of the power tool via the grip part can be ensured at all times. Transmission of vibrations via the retaining element can be prevented by means of the movable design of the retaining element when [the power tool is] operated properly. The mounting part is advantageously designed as a piece separate from the housing, although it can also be designed at least partially integrated with the housing of the power tool.

In a further embodiment, however, it is proposed that the retaining element is formed by a flexible element, e.g., by a chain or, advantageously, by a plastic or wire rope, etc. When a flexible retaining element is used, a transmission of vibrations can be prevented cost-effectively using a simple design, and the retaining element can be favorably integrated in the elastic element.

In order to protect the retaining element from damage during operation of the power tool, and to make a concealed integration of the retaining element in the handle possible, the elastic element advantageously encloses the retaining element.

It is further proposed that the retaining element is located in the elastic element in the center along a centerline, by way of which, when a tilting motion takes place, undesired tensile stresses in the retaining element and a transmission of vibration associated therewith can be prevented.

If the retaining element, in the installed state, is subjected to compressive stresses, and the elastic element is subjected to tensile stresses, a higher loadability of the elastic element can be achieved than without pretension, and breakage or separation from the grip part and from the mounting part and/or a tearing of the elastic element can be prevented. Moreover, the retaining element can be used advantageously to secure the elastic element to the grip part and to the mounting part, e.g., in that the retaining element applies a contact force necessary for a cemented joint. The compressive stress can be advantageously achieved in the elastic element by tensioning the retaining element, e.g., by tensioning a flexible retaining element—advantageously located in the middle of the elastic element along a centerline—using a fastening screw.

In a further embodiment according to the invention, it is proposed that the retaining element is formed by a band that encloses the elastic element. The retaining element designed in the shape of a band can protect the elastic element—formed out of a usually soft material—against outside influences and damage during operation, e.g., against heat, effects of ultraviolet radiation, dust, moisture, and hard objects, etc., by means of its closed surface. The band can be produced out of various materials appearing reasonable to one skilled in the art, e.g., out of fabric tape, etc. Basically, the retaining element can also be formed cost-effectively out of at least one flexible component that is located radially outside of the elastic element, e.g., out of one or more ropes.

In order to protect the elastic element from outside influences, it can also be enclosed in a sleeve made of solid material, which sleeve can be secured to the grip part or the mounting part and is located at a distance from the grip part or the mounting part in order to prevent transmission of vibrations.

The retaining element can be formed out of a rigid component instead of a flexible component, which rigid component is supported in movable fashion relative to the mounting part and/or the grip part. The retaining element can be designed to be easily installed or removed, so it can be replaced if damaged. Moreover, a maximum displacement of the elastic element from a normal position can be easily determined in at least one tilting direction and/or one sliding direction via the retaining element and, in particular, via a rigid retaining element. An overstretching of the elastic element can be prevented by means of the retaining element, and a long service life can be achieved.

The retaining element is advantageously supported firmly in the mounting part and in movable fashion relative to the grip part, whereby a space in the grip part can advantageously be used for a freedom of motion of the retaining element and a simple installation starting with the grip part can be achieved. Moreover, a fastening screw located in the mounting part can be used for a firm connection of the retaining element. Additional mounting parts for the retaining element can be spared. Basically, however, the retaining element can also be designed to be rigid in the grip part and movable in relation to the mounting part.

It is further proposed that the retaining element is formed by a screw that can be screwed particularly advantageously into the fastening screw in the mounting part. A screw is particularly cost-effective and can be installed and removed particularly easily and quickly. Instead of a screw, however, a bolt could be used that can be secured either in the grip part or in the mounting part in positive, non-positive, and/or bonded fashion, e.g., it can be pressed in the fastening screw in the mounting part.

In addition to a rigid bar, a screw, a chain, and a rope, furthermore, a spring can be used as the retaining element, in particular a coiled spring. Using a fastening element formed by a coiled spring, a particularly simple installation can be achieved, particularly in automated series production.

In order to make an advantageous uniform cooling, and advantageously homogenous microstructure, and an advantageously bonded connection to the mounting part and/or the grip part possible after injection molding of the elastic element, the elastic element comprises a non-circular cross-sectional area at least closely before an advantageously round seating surface with the mounting element and/or with the grip part that is smaller than the seating surface, and, in fact, the cross-sectional area is composed particularly advantageously of a round core area and arched extensions abutting the core area radially on the outside. Using a round contour, an advantageously large seating surface between the elastic element and the mounting part and the grip part can be achieved. The seating region can be cooled advantageously by means of the smaller cross-sectional area abutting this.

Moreover, an advantageous microstructure can be enhanced by dissipating heat from an internal region of the elastic element via at least one component during production of the elastic element. The component can be formed by means of a retaining element inserted in the elastic element during production itself, or advantageously by a core that is removed after the elastic element is manufactured, and advantageously forms a recess for the retaining element. Advantageously, the core can be cooled compared to the inserted retaining element using a coolant by means of a cooling passage. When using retaining elements in particular that are formed out of rigid components and that can be installed easily after production of the elastic element, it is advantageous that the elastic element can be cooled by means of a core during production.

The means of attaining the object of the invention can be used with various power tools appearing practical to one skilled in the art, e.g., with hammer drills, rotary hammers, drills, power-operated screw drivers, sawing, milling, planing, etc. The means of attaining the object of the invention according to the invention can be used with particular advantage in angle grinders, however, and, in fact, using an additional handle extending transversely to the longitudinal direction, which serves primarily to guide the angle grinder.

BRIEF DESCRIPTION OF THE DRAWING

Further advantages arise from the following drawing description. Exemplary embodiments of the invention are presented in the drawing. The drawing, the description, and the claims contain numerous features in combination. One skilled in the art will advantageously consider them individually as well and combine them into reasonable further combinations.

DETAILED DESCRIPTION OF THE EXEMPLARY EMBODIMENT

Figure 1:
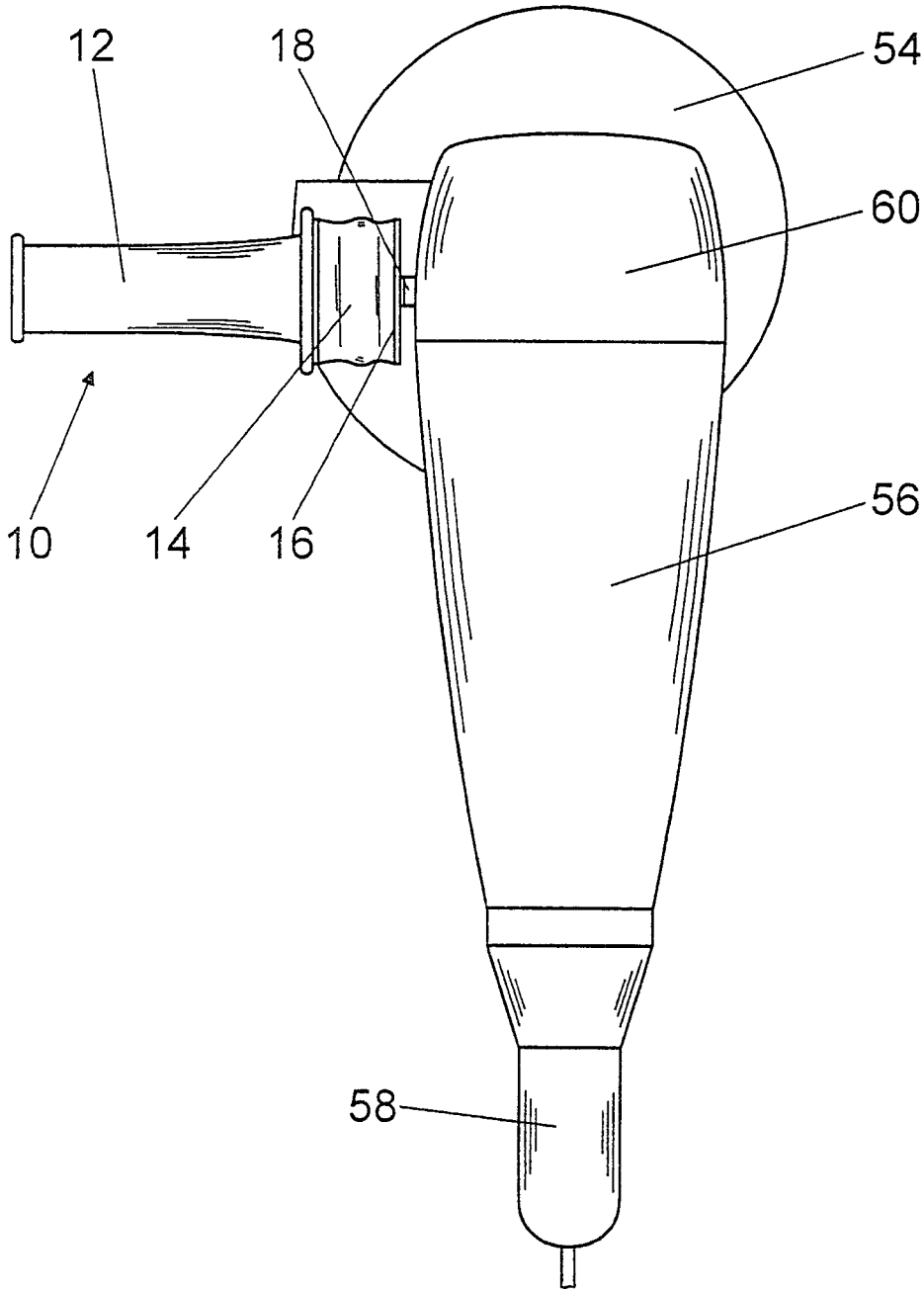
FIG. 1 shows a schematic representation of an angle grinder from above.

FIG. 1 shows an angle grinder having an electric motor (not shown) supported in a housing 56, via which a cutoff wheel clamped in the toolholder is driveable. The angle grinder is guidable via a first handle 58 integrated in the housing 56 on the side opposite to the cutoff wheel 54 and extending in the longitudinal direction, and via a second handle 10 secured to a gearbox housing 60 in the region of the cutoff wheel 54 or the toolholder and extending transversely to the longitudinal direction. The handle 10 comprises a grip part 12 that is firmly connected via an elastic, vibration-damping plastic element 14 to a mounting part 16, via which the grip part 12 is secured to the gearbox housing 60 of the angle grinder via a set screw 18 integrally molded to the mounting part 16. The elastic plastic element 14 is integrally extruded on the grip part 12 and the mounting part 16 and, as a result, is firmly connected to them.

Figure 2:
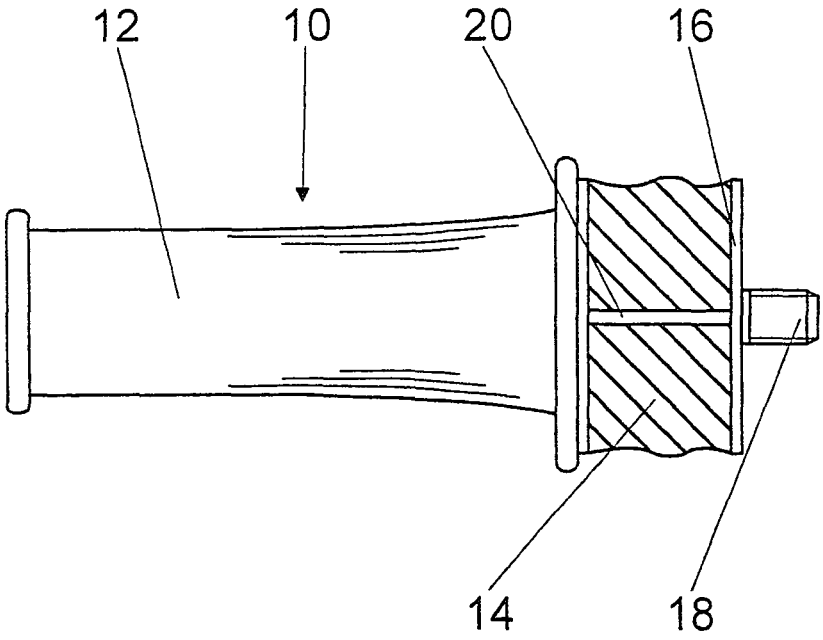
FIG. 2 shows a handle according to the invention comprising a flexible retaining element enclosed in an elastic element.

According to the invention, the grip part 12, in addition to the elastic plastic element 14, is connected to the mounting part 16 via a movable retaining element 20 (FIG. 2). The retaining element 20 is formed by a flexible component in the form of a wire rope and is located in the elastic plastic element 14 along a centerline. Threaded sleeves (not shown) are secured to the ends of the retaining element 20, via which the retaining element 20 is screwed to the grip part 12 and the mounting part 16. The elastic plastic element 14 encloses the retaining element 20. The retaining element 20, in the installed state, is subjected to tensile stresses, and the elastic element 14 is subjected to compressive stresses.

Figure 3:
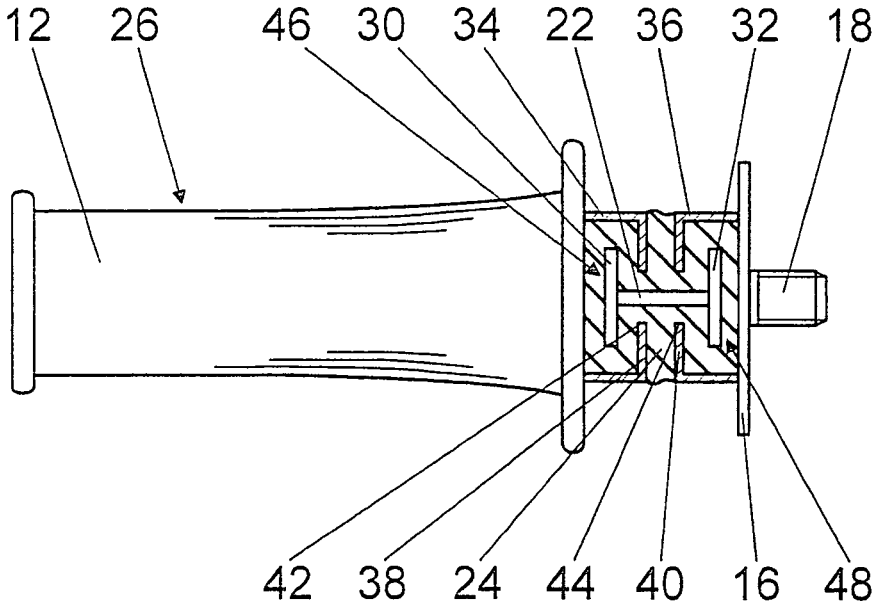
FIG. 3 shows a handle with a retaining element designed in the shape of a rod.

FIG. 3 shows a further embodiment of a handle 26 according to the invention, in which a retaining element 22 is formed by a rigid rod supported in movable fashion and enclosed in an elastic plastic element 24 applied by injection molding, to the ends of which washers 30, 32 are secured in each case. Components that are essentially identical are labelled with the same reference numerals in the exemplary embodiments presented. With regard for features and functions that remain the same, reference is made to the description of FIG. 1.

One sleeve 34, 36 each is secured to the mounting part 16 and the grip part 12, each of which comprises a washer 38, 40 having coaxial openings 42, 44 in the direction toward the elastic plastic element 24. The sleeves 34, 36 and the washers 38, 40 each abut a space 46, 48 filled via injection with an elastic material, into which the retaining element 22 with its washers 30, 32 is inserted. The washers 30, 32 of the retaining element 22 have a larger diameter than the openings 42, 44 and are held captive in the spaces 46, 48.

For installation, the washer 30 can be unscrewed from the rod-shaped part of the retaining element 22. The retaining element 22 can then be inserted into this—before installation of the sleeves 34, 36 with the grip part 12 or the mounting part 16—and the washer 30 can be screwed to the rod-shaped part once more. The sleeves 34, 36 are connected to the grip part 12 or the mounting part 16 via threaded joints (not shown). After the sleeves 34, 36 are connected to the grip part 12 and the mounting part 16, the retaining element 22 is coated with elastic plastic applied by injection molding.

The sleeves 34, 36, with their washers 38, 40, advantageously produce a positive connection between the grip part 12 and the elastic plastic element 24, and between the elastic plastic element 24 and the mounting part 16. Basically, however, the elastic plastic element could be designed with the retaining element, the sleeves, and the washers as an assembly capable of being preassembled, which is then screwed and cemented to the grip part and the mounting part.

A maximum displacement of the elastic plastic element 24 is determined by a freedom of motion of the washers 30, 32 of the retaining element 22 in the spaces 46, 48, in all directions, in fact. In order to prevent a transmission of vibrations via the retaining element 22, the retaining element 22 is situated at a distance—filled with an elastic material—from the sleeves 34, 36 and the washers 38, 40 when [the power tool] is operated properly.

Figure 4:
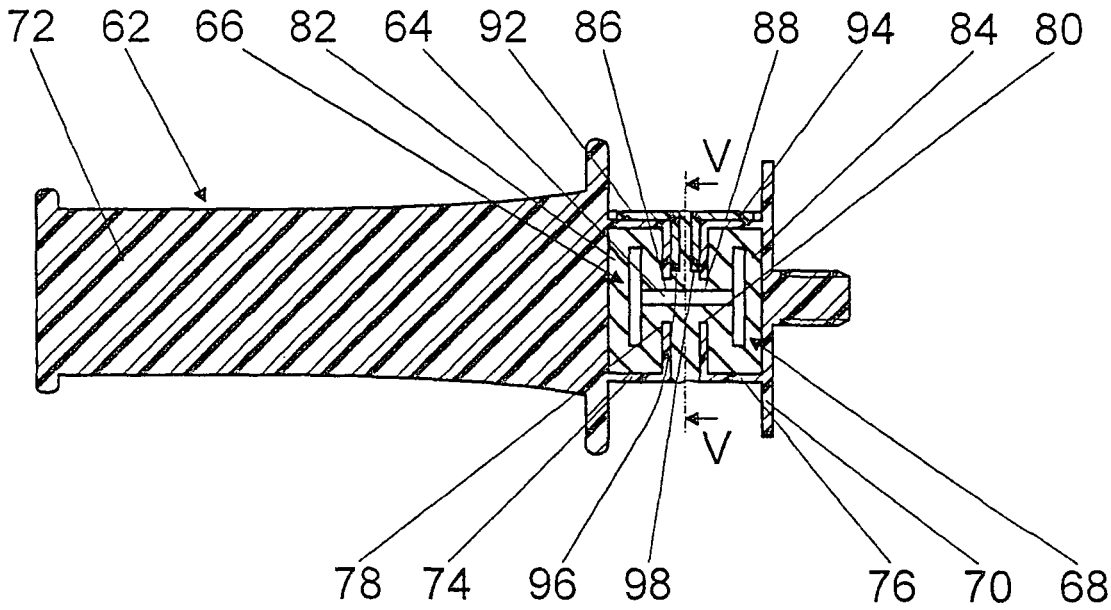
FIG. 4 shows a section of an alternative to FIG. 3.
Figure 5:
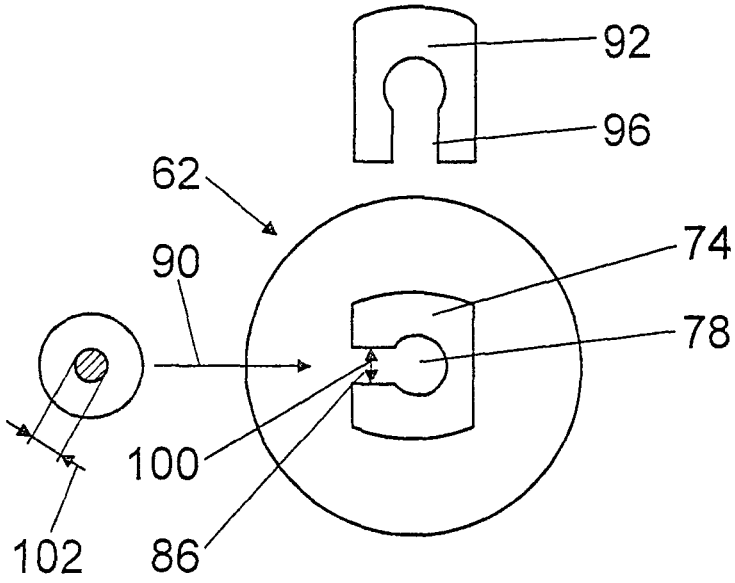
FIG. 5 shows a view along the line V-V in FIG. 4 during assembly.

A further exemplary embodiment of a handle 62 is shown in FIGS. 4 and 5, in which a retaining element 64 is formed by a rigid rod supported in movable fashion and comprising a coating of an elastic plastic element 24 applied by injection molding, the ends 66, 68 of which are designed in the shapes of washers. With regard for features and functions that remain the same, reference is made to the description of FIG. 3.

One structural part 74, 76 each is integrally molded to a mounting part 70 and a grip part 72, each of which is designed in the shape of a washer in the direction toward the elastic plastic element 24 and which comprise coaxial openings 78, 80.

The structural parts 74, 76 each abut a space 82, 84 filled with an elastic material applied by injection, into which the retaining element 64—designed as a single piece—is inserted with its washer-shaped ends 66, 68 during assembly. The retaining element 64 with its rod-shaped part is thereby guided transverse to the longitudinal direction of the handle 62 through lateral openings 86, 88 in the structural parts 74, 76 (FIG. 5). The retaining element 64 is then secured in the structural parts 74, 76 against the direction of its insertion 90 by means of the openings 86, 88 by pushing structural parts 92, 94—each of which has an L-shape in the longitudinal view—perpendicular to the direction of insertion 90 and transverse to the longitudinal direction with one opening 96, 98 each over the rod-shaped part of the retaining element 64. The rod-shaped ends 66, 68 of the retaining element 64 have a greater diameter than the openings 78, 80 and are held captive in the spaces 82, 84. The retaining element 64 is then coated with plastic applied by injection molding.

A width 100 of the openings 86, 88 transverse to the longitudinal direction of the handle 62 and perpendicular to the direction of insertion 90 of the retaining element 64 is advantageously designed smaller than a diameter 102 of the rod-shaped part of the retaining element 64, so that the retaining element 64 must be pushed through the openings 86, 88 against resistance and then locks in place in the openings 78, 80 of the structural parts 74, 76. The retaining element 64 is secured in the openings 78, 80 of the structural parts 74, 76, and the structural parts 92, 94 can be advantageously spared.

Figure 6:
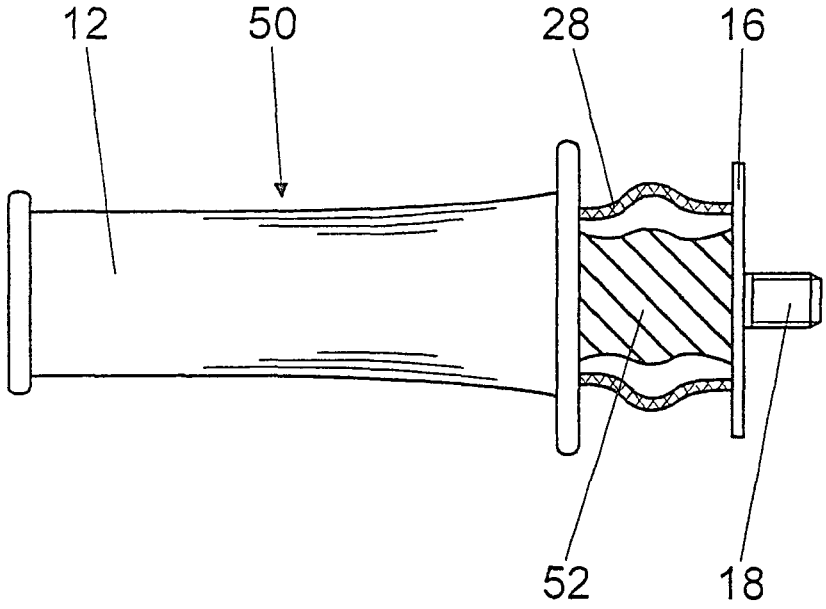
FIG. 6 shows a handle comprising an elastic element enclosed by a retaining element designed in the shape of a band.
Figure 7:
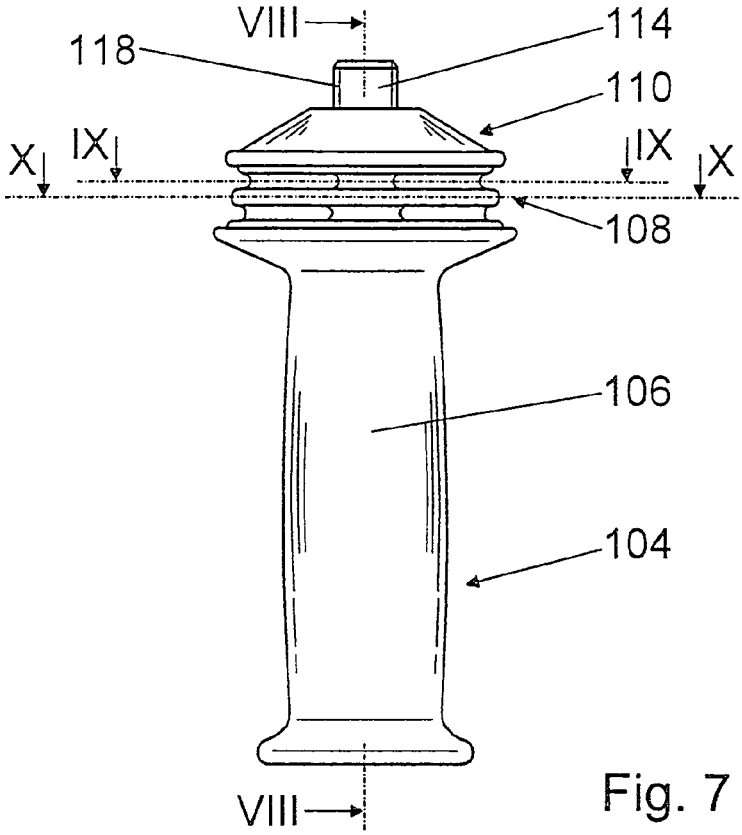
FIG. 7 shows a variant of FIG. 3.

FIG. 6 shows a further exemplary embodiment of a handle 50 in which, according to the invention, a retaining element 28 is formed by a flexible fabric tape that encloses an elastic plastic element 52. The band-shaped retaining element 28 is designed to be essentially non-elastic in the longitudinal direction of the handle 50 and comprises a plastic flange (not shown) abutting the grip part 12 and abutting the mounting part 16 in each case, with which the band-shaped retaining element 28 is firmly connected to the grip part 12 or with the mounting part 16 via arresting connections.

In order to prevent a transmission of vibrations via the retaining element 28, it is designed longer than the elastic plastic element 52. The elastic plastic element 52 is protected by the retention element 28 against outside influences and damage while the angle grinder is in use. Moreover, a maximum displacement of the elastic plastic element 52 from its normal position is determined by the retention element 28 and, in fact, in the directions of push, tilt, and pull. In the maximum displacement positions, the retention element 28 is tensioned and prevents a further displacement of the elastic plastic element 52.

Figure 8:
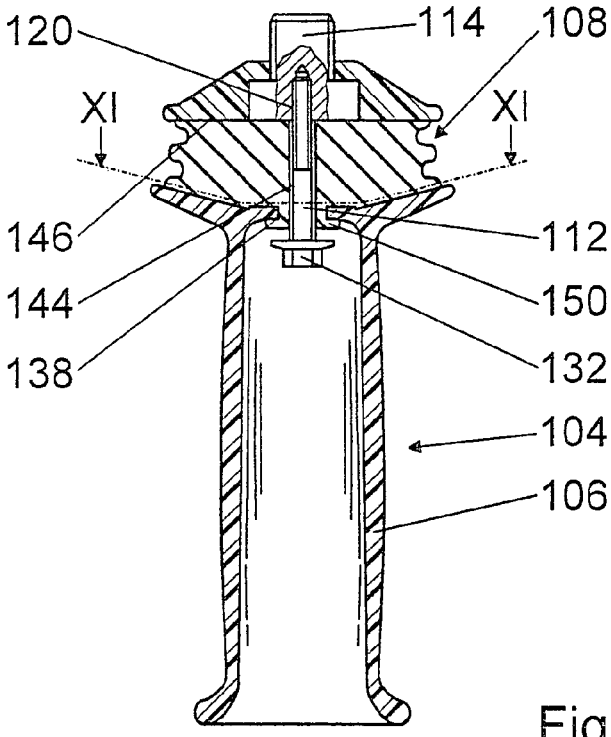
FIG. 8 shows a view along the line VIII-VIII in FIG. 7.

A handle 104 that is an alternative to the exemplary embodiment in FIG. 3 is shown in FIGS. 7 through 12. The handle 104 comprises a mounting part 110 that is firmly connected via an elastic plastic element 108 with a grip part 106. The connection between the mounting part 110 and the grip part 106 is secured via a retention element 112 formed by a screw (FIG. 8).

Figure 9:
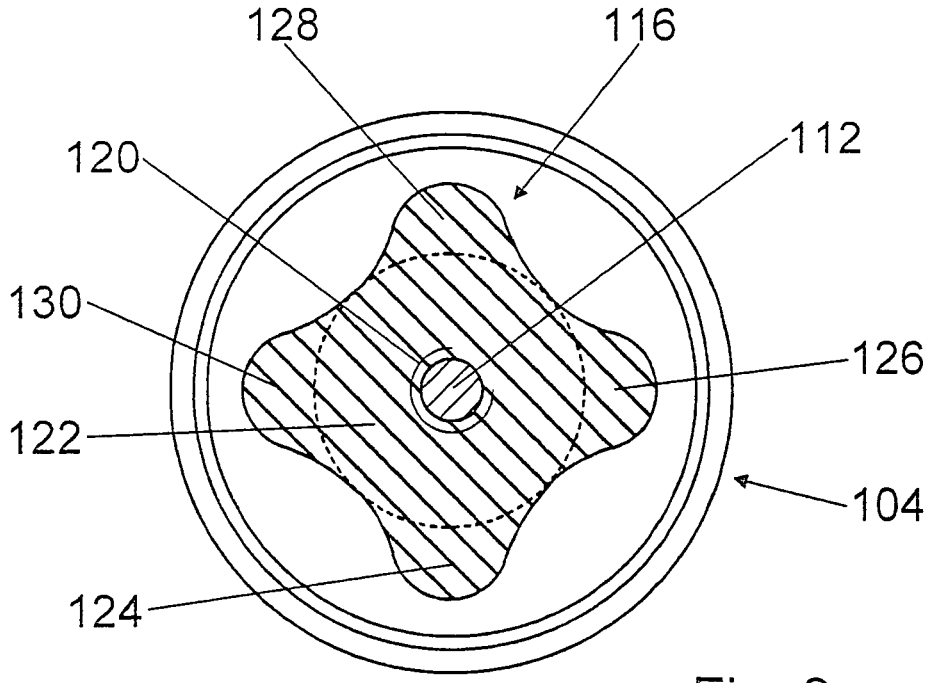
FIG. 9 shows a view along the line IX-IX in FIG. 7.
Figure 10:
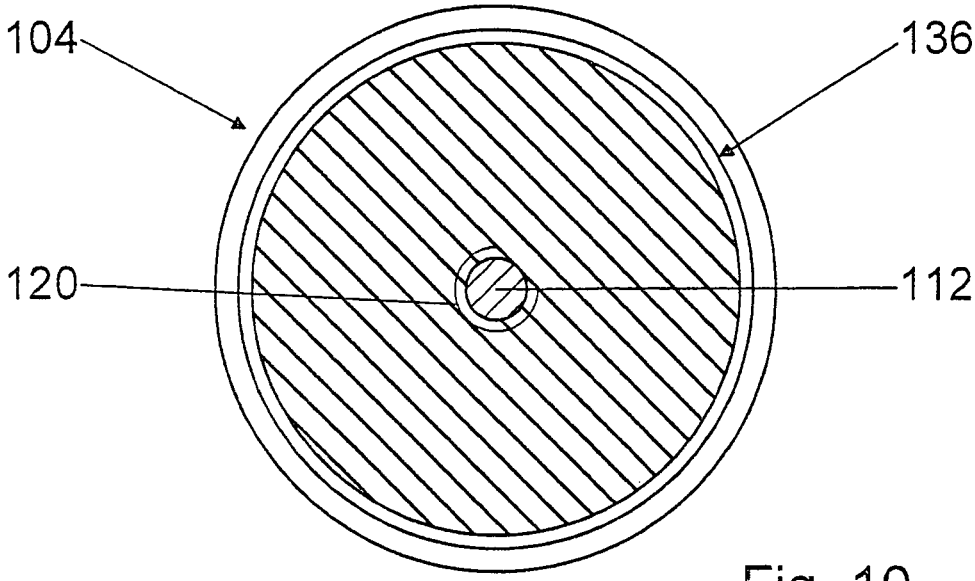
FIG. 10 shows a view along the line X-X in FIG. 7.
Figure 11:
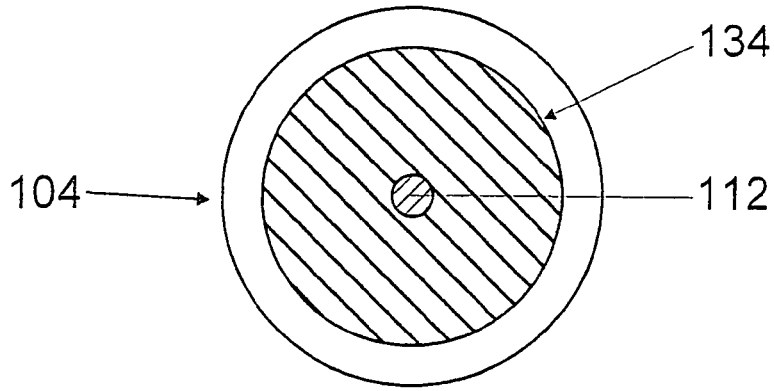
FIG. 11 shows a view along the line XI-XI in FIG. 7.
Figure 12:
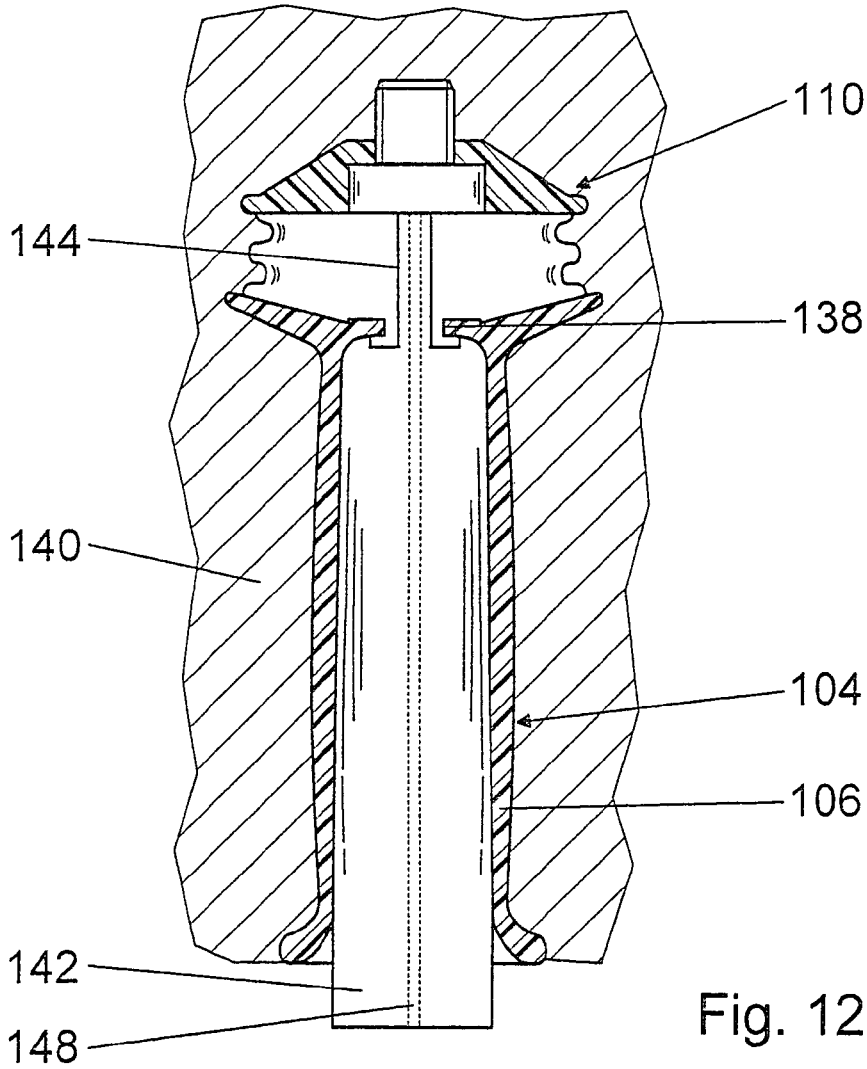
FIG. 12 shows a handle according to FIG. 7 during its production.

During production of the handle 104, the mounting part 110 and the grip part 106 are first produced out of plastic via injection molding, and a fastening screw 114 is inserted in the mounting part 110 and coated via injection molding with positive engagement in the axial direction and in the direction of rotation, which fastening screw 114 comprises an external thread 118 as well as an internal thread 120 for fastening to a machine housing in the direction of the grip part 106. The fastening screw 114 could also be pressed into a mounting part afterwards. After applying a coating to the fastening screw 114 via injection molding, the mounting part 110 with the fastening screw 114 and the grip part 106 are placed in a casting mold 140 in order to become bonded to the elastic plastic element 108 in an injection molding procedure (FIG. 12). The casting mold 140 is shaped so that the elastic plastic element 108 comprises a non-circular cross-sectional area 116 closely before a round seating surface 146 with the mounting part 110 and a round seating surface 134 with the grip part 106, each of which is smaller than the seating surfaces 134, 146 and, in fact, the cross-sectional areas 116 each comprises a round core area 122 abutted radially on the outside by four arched extensions 124, 126, 128, 130 (FIGS. 9 and 11). More or fewer than four arched extensions 124, 126, 128, 130 would also be possible. The elastic plastic element 108 comprises a round cross-sectional area 136 in a center region (FIG. 10).

Moreover, a core 142 cooled via a fluid passage 148 is placed in the casting mold 140 that forms a recess 144 for the retention element 112, via which core 142 heat is dissipated from the interior region of the elastic plastic element 108 during production. The grip part 106 is designed hollow inside and comprises a recess 138 in the direction of the mounting part 110 through which the core 142 extends, and which is partially filled with the elastic plastic element 108 applied via injection, so that a flange 150 of the elastic plastic element 108 grips behind an edge region of the recess 138.

Once the elastic plastic element 108 has cooled and the core 142 has been removed, the retention element 112 of the grip part 106 is guided through the recess 144 formed by the core 142 in the direction of the mounting part 110 through the elastic plastic element 108 and is screwed into the interior thread 120 in the fastening screw 114. The retention element 112 comprises a screw head 132 that, when the retention element 112 is installed, is situated at a distance from the grip part 106, so that the retention element 112 is supported in movable fashion relative to the grip part 106. The screw head 132 is larger than the recesses 138 and 144, so that, if the elastic plastic element 108 becomes damaged, the grip part 106 is connected to the mounted part 110 in captive fashion. The distance between the screw head 132 and the grip part 106 determines a maximum permissible displacement of the elastic plastic element 108. Direct contact between the screw head 132 and the grip part 106 is prevented and transmission of vibrations is largely prevented by means of the flange 150 when maximum displacement occurs.

REFERENCE NUMERALS

10 handle
12 grip part
14 element
16 mounting part
18 set screw
20 retaining element

22 retaining element
24 element
26 handle
28 retaining element
30 washer
32 washer
34 sleeve
36 sleeve
38 washer
40 washer
42 opening
44 opening
46 space
48 space
50 handle
52 element
54 cutoff wheel
56 housing
58 handle
60 gearbox housing
62 handle
64 retaining element
66 end
68 end
70 mounting part
72 grip part
74 structural part
76 structural part
78 opening
80 opening
82 space
84 space
86 opening
88 opening
90 direction of insertion
92 structural part
94 structural part
96 opening
98 opening
100 width
102 diameter
104 handle
106 grip part
108 element
110 mounting part
112 retaining element
114 fastening screw
116 cross-sectional area
118 external thread
120 internal thread
122 core area
124 extension
126 extension
128 extension
130 extension
132 screw head
134 seating surface
136 cross-sectional area
138 recess
140 casting mold
142 component
144 recess
146 seating surface
148 fluid passage
150 flange

What is claimed is:

1. A power tool with at least one handle, said handle comprising at least one grip part that is firmly connected to and firmly held at a mounting part by at least one elastic, vibration-damping element, wherein the grip part is affixed to a housing via the mounting part, and wherein the connection between the grip part and the mounting part by means of the elastic element is secured by at least one movable retaining element, wherein the retaining element is formed by a flexible component, wherein the retaining element is formed by a rope.

2. A power tool with at least one handle, said handle comprising at least one grip part that is firmly connected to and firmly held at a mounting part by at least one elastic, vibration-damping element located between the grip part and the mounting part, wherein the grip part is affixed to a housing via the mounting part which is screwed into the housing so that the elastic element is mounted to the housing through the mounting part and also mounted to the grip part; and wherein the connection between the grip part and the mounting part by means of the elastic element is secured by at least one movable retaining element that prevents a separation of the grip part from the housing if the elastic element is damaged and ensures control of the power tool via the grip part at all times.

3. The power tool according to claim 2, wherein the retaining element is formed by a flexible component.

4. The power tool according to claim 2, wherein the retaining element is located in the elastic element along a centerline.

5. The power tool according to claim 2, wherein the retaining element, in the installed state, is subjected to tensile stresses, and the elastic element is subjected to compressive stresses.

6. The power tool according to claim 2, wherein the retaining element is formed by a band that encloses the elastic element.

7. The power tool according to claim 6, wherein a maximum displacement of the elastic element is determined by means of the retaining element in at least one tilting direction.

8. The power tool according to claim 2, wherein the retaining element is formed by a rigid component that is supported in movable fashion relative to the mounting part.

9. The power tool according to claim 8, wherein the retaining element is formed by a rigid component and is firmly supported in the mounting part and movable relative to the grip part.

10. The power tool according to claim 9, wherein the retaining element is firmly connected to a fastening screw located in the mounting part.

11. The power tool according to claim 9, wherein the retaining element is formed by a screw.

12. The power tool according to claim 8, wherein the retaining element is connected to the grip part via the elastic element and to the mounting part via the elastic element.

13. The power tool according to claim 2, wherein the elastic element comprises a non-circular cross-sectional area at least closely before a seating surface of the elastic element for at least one element, the element being an element selected from the group consisting of the mounting element and the grip part, wherein the cross-sectional area is smaller than the seating surface.

14. The power tool according to claim 2, wherein the elastic element encloses the retaining element.

15. The power tool according to claim 2, wherein the grip part comprises a recess, in which the retaining element is located.

16. The power tool according to claim 15, wherein the recess is partially filled with the elastic element.

17. The power tool according to claim 15, wherein the retaining element is formed by a screw having a screw head which is larger than the recess.

18. The power tool according to claim 17, wherein the elastic element has a flange preventing a direct contact between the screw head and the grip part.

19. The power tool according to claim 15, wherein the elastic element has a flange gripping behind an edge region of the recess.

20. The power tool according to claim 2, wherein by the retaining element the grip part is connected to the mounting part in captive fashion.

* * * * *